US010612153B2

(12) United States Patent
Ivanovskaya et al.

(10) Patent No.: US 10,612,153 B2
(45) Date of Patent: Apr. 7, 2020

(54) METHOD FOR ELECTROCHEMICAL ROUGHENING OF THIN FILM ELECTRODES

(71) Applicants: Anna Nikolaevna Ivanovskaya, Mountain View, CA (US); Vanessa Tolosa, Oakland, CA (US); Dylan Dahlquist, Folsom, CA (US); Satinderpall S. Pannu, Pleasanton, CA (US); Kedar G. Shah, San Francisco, CA (US); Angela C. Tooker, Dublin, CA (US); Fang Qian, Santa Cruz, CA (US)

(72) Inventors: Anna Nikolaevna Ivanovskaya, Mountain View, CA (US); Vanessa Tolosa, Oakland, CA (US); Dylan Dahlquist, Folsom, CA (US); Satinderpall S. Pannu, Pleasanton, CA (US); Kedar G. Shah, San Francisco, CA (US); Angela C. Tooker, Dublin, CA (US); Fang Qian, Santa Cruz, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 132 days.

(21) Appl. No.: 15/615,648

(22) Filed: Jun. 6, 2017

(65) Prior Publication Data

US 2017/0350034 A1 Dec. 7, 2017

Related U.S. Application Data

(60) Provisional application No. 62/346,415, filed on Jun. 6, 2016.

(51) Int. Cl.
*C25F 3/14* (2006.01)
*C25F 3/02* (2006.01)
*C25F 7/00* (2006.01)

(52) U.S. Cl.
CPC ..... *C25F 3/14* (2013.01); *C25F 3/02* (2013.01); *C25F 7/00* (2013.01)

(58) Field of Classification Search
CPC ..... C25F 3/02–14
See application file for complete search history.

(56) References Cited

U.S. PATENT DOCUMENTS 3,515,615 A * 6/1970 Hasegawa ..... B29C 59/16 156/273.3
2011/0174635 A1* 7/2011 Hotta ..... B41N 3/034 205/658

OTHER PUBLICATIONS

Wefermo (Investigating the Interfacial Properties of Electrochemically Roughened Platinum Electrodes for Neural Stimulation, Langmuir, 31, 2975-2599 (2015)) (Year: 2015).*

(Continued)

*Primary Examiner* — Nicholas A Smith
(74) *Attorney, Agent, or Firm* — James S. Tak

(57) ABSTRACT

The present invention relates to surface roughening methods and more particularly to a method for electrochemical roughening of thin film macro- and micro-electrodes. In one embodiment, an electrochemical etch template is formed comprising polymer particles adsorbed on a surface of a substrate to be roughened, followed by electrochemically etching of exposed regions of the substrate between the polymer particles in the electrochemical etch template so as to selectively roughen the surface of the substrate. In another embodiment, a surface of the electrode is immersed in either a adsorbing acidic solution, such as sulfuric acid, or a non-adsorbing acidic solution, such as perchloric acid, followed by electrochemically pulse etching the surface of the (Continued)

substrate at a narrow frequency range for adsorbing acidic solutions, or at a wide frequency range for non-adsorbing acidic solutions.

7 Claims, 8 Drawing Sheets

(56) References Cited

OTHER PUBLICATIONS

Josowicz et al., "Electrochemical Pretreatment of Thin Film Platinum Electrodes," J. Electrochem. Soc.: Electrochemical Science and Technology, 135, pp. 112-115, 1988 (Year: 1988).*
Cai, et al., "Investigation of surface-enhanced Raman scattering from platinum electrodes using a confolcal Raman microscope: dependence of surface roughering pretreatment", Surface Science, 406, pp. 9-22 (1998).
Bartlett, et al., "Highly Ordered Macroporous Gold and Platinum Films Formed by Electrochemical Deposition Through Template Assembled from Submicron Diameter Monodisperse Polystyrene Spheres", Chem. Mater., 14, pp. 2199-2208 (2002).
Xue, et al., "Electrodeposition of mesoporous manganese dioxide supercapacitor electrodes through self-assembled triblock copolymer templates", Science Direct, 164, pp. 953-958, (2007).

* cited by examiner

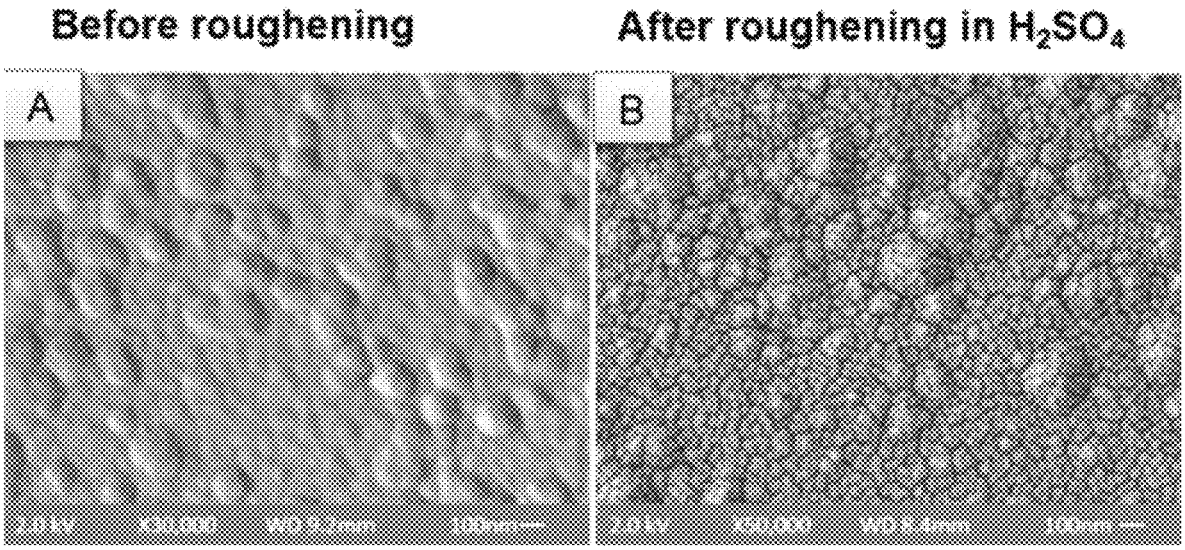
Figure 12A
Figure 12B
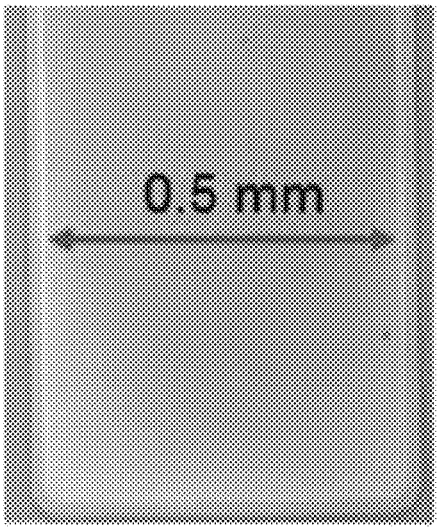
Figure 13

METHOD FOR ELECTROCHEMICAL ROUGHENING OF THIN FILM ELECTRODES

FEDERALLY SPONSORED RESEARCH OR DEVELOPMENT

The United States Government has rights in this invention pursuant to Contract No. DE-AC52-07NA27344 between the United States Department of Energy and Lawrence Livermore National Security, LLC for the operation of Lawrence Livermore National Laboratory.

BACKGROUND

The present invention relates to surface roughening methods and more particularly to a method for electrochemical roughening of thin film electrodes for increasing active surface area, decreasing electrode impedance, increasing charge injection capacity, increasing sensitivity of biosensors and improving adhesion to substrates.

Thin film microfabrication techniques have enabled miniaturization and reproducibility of electrodes used in neurorecording and neuromodulation chronic biomedical devices as well as in biosensors. However, the reduction in an electrode's geometric surface area can compromise important electroactive characteristics of electrodes used for a wide range of biomedical applications, such as for example, 1) diminishes the amount of charge that can be safely delivered by the electrode during neuro-stimulation; 2) shows undesirable increases in impedance for recording electrodes; and 3) decreases electrochemical signals measured with biosensors.

In order to develop devices with greater spatial resolution while maintaining the same electroactive functionality, microelectrodes must be able to have enhanced performance compared to the performance of macroelectrodes. Generally, this may be accomplished by 1) depositing thin film coating of different material with enhanced electrochemical activity over the surface of the electrode; or 2) increasing the effective surface area of the electrode while keeping the geometric surface area the same. In the case of depositing a different material electroactive thin film coating over the electrode to improve performance of an electrode, however, this often results in poor adhesion of the deposited film to the electrode surface. And poor film adhesion leads to absence of mechanical robustness of implantable device which may result in immediate delamination or decreased lifetime of the electrode upon implantation.

In many cases poor adhesion can be greatly improved by roughening of a substrate prior to film deposition. Several methods are known for increasing the effective surface area for a given geometric surface area, including for example: (1) roughening a planar electrode through some form of etching, e.g. by a physical etching of the surface using some form of plasma with inert gases or chemical etching with an acid or base, (2) depositing a rough, high-surface-area electrode material on top of a flat or roughened surface of a planar electrode by electrochemical deposition, e.g. electroplating, electrophoretic deposition, through binding/casting of nano- or microparticles, or through chemical vapor deposition, sputtering, or evaporation of nano- or microparticles. In addition, methods for roughening of thick metal and foil electrodes are also known. Platinum, gold, and palladium thick metal and foil electrodes can be roughened electrochemically by application of short bipolar pulses with oxide forming during anodic pulse and oxide etching during cathodic pulse. Electrochemical etching methods are highly attractive because of high increase in surface area, good process control, low cost and low toxicity. Unfortunately, these methods are not applicable to roughening thin films, since films often fail mechanical stress introduced during electrochemical etching process and loose mechanical integrity. Thus, existing roughening methods known to work for thick metals and metal foils are not directly applicable for thin film electrodes and often results in film delamination from the substrate.

High surface area electrodes are desirable for applications that rely on electrical charge delivery, low impedance, and improved adhesion between substrate and electroplated films. There is therefore a need to increase the effective or active surface area of a thin film electrode to increase the electrode charge injection capacity, without increasing the geometric area of the microfabricated thin film electrode. Moreover, there is also a need for surface roughening method that may be used for roughening thin film electrodes without causing delamination.

SUMMARY

One aspect of the present invention includes a method of electrochemically roughening a substrate, comprising: forming an electrochemical etch template comprising polymer particles adsorbed on a surface of a substrate to be roughened; and electrochemically etching exposed regions of the substrate defined by voids between the polymer particles in the electrochemical etch template so as to selectively roughen the surface of the substrate.

In another aspect of the present invention, the step of forming the electrochemical etch template includes coating a surface of the substrate with an aqueous solution comprising polymer and acid, and heating the aqueous solution so that the polymer and water form a solid domain of a liquid crystal which forms an electrochemical etch template on the surface of the substrate.

In another aspect of the present invention, the step of forming the electrochemical etch template includes coating a surface of the substrate with polystyrene microspheres.

Another aspect of the present invention includes a method of electrochemically roughening a Pt thin film substrate, comprising: immersing a surface of the substrate in an adsorbing acidic solution; and electrochemically pulse etching the surface of the substrate, wherein the electrochemical pulse etching is performed in a frequency range of about 150 Hz to about 450 Hz.

In another aspect of the present invention, the adsorbing acidic solution is sulfuric acid.

Another aspect of the present invention includes a method of electrochemically roughening a Pt thin film substrate, comprising: immersing a surface of the substrate in a non-adsorbing acidic solution; and electrochemically pulse etching the surface of the substrate, wherein the electrochemical pulse etching is performed in a frequency range of about 250 Hz to about 5000 Hz.

In another aspect of the present invention, the non-adsorbing acidic solution is perchloric acid.

These and other implementations and various features and operations are described in greater detail in the drawings, the description and the claims.

BRIEF DESCRIPTION OF THE DRAWINGS

FIGS. 12A and 12B show surface morphology obtained by Scanning Electron Microscopy of spattered Pt film before (FIG. 12A) and after (FIG. 12B) roughening in sulfuric acid FIG. 13 shows the microscopy of surface of roughened in perchloric acid thin film rectangular shape macro-electrode (0.5×1.5 mm dimensions), with roughness factor: 44.

DETAILED DESCRIPTION

1. Thin Film Electrode Surface Roughening with Polymer Particle-based Electrochemical Etch Template.

A. General Case

In one example embodiment, the present invention is directed to a method of nanoscale surface roughening of a thin film conductive electrode material using a polymer particle-based electrochemical etch template. The electrochemical etch template is formed/patterned on an electrode surface for controlling where the oxidation and reduction occurs on the electrode as part of the etching phase. The template comprises polymer particles (e.g. microspheres or micelles formed from triblock copolymers) adsorbed on the electrode surface, and having void spaces between the polymer particles. Electrochemical etching is then performed on the templated electrode surface, so that electrochemical etching is achieved selectively only at the areas of the electrode surface adjacent the void spaces. The roughened thin film may be subsequently used as a substrate for electrodeposition of material, wherein the increase in interface contact area between substrate and plated film allows for better adhesion of film to the substrate. As used herein and in the claims, "thin films" are considered films with thickness ranging from about 20 nm to about 5 micron, and "nanoscale surface roughness" describes surfaces with RMS values between a few nanometers and 1 micron. The roughening method is sufficiently mild to be safe for thin films, allowing for the increase in effective or active surface area, decreased impedance, and improved adhesion of subsequently deposited material. The resulting thin film electrode may exhibit increased charge injection capacity (e.g. greater than 10×) as compared to a planar electrode surface of the same geometric surface area. Adhesion of deposited material to the substrate may also be improved so as to increase lifetime of chronically implantable neural stimulation electrodes.

Figure 1:
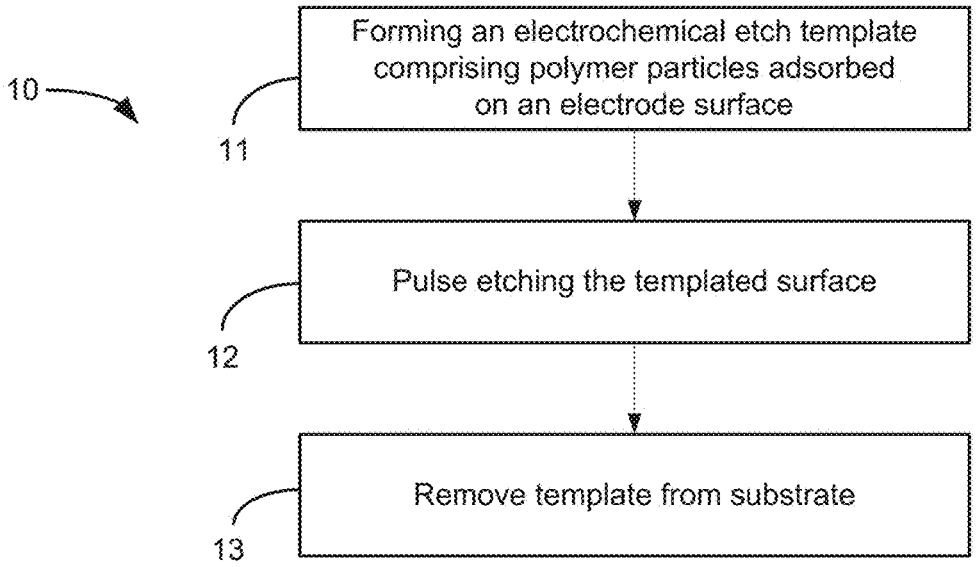
FIG. 1 is a flowchart of a first example embodiment of a method of nanoscale surface roughening of a thin film conductive electrode material using a polymer particle-based electrochemical etch template, of the present invention.

Turning now to the drawings, FIG. 1 shows a flowchart of an example embodiment of the method of nanoscale surface roughening of a thin film conductive electrode material using a polymer particle-based electrochemical etch template of the present invention, generally indicated at 10. Generally, as shown at block 11, an electrochemical etch template is first formed on the surface of an electrode substrate, wherein the template comprises polymer particles with voids therebetween. Next at block 12, the templated electrode substrate is then pulse etched (by oxidation and reduction) to etch the substrate adjacent the voids of the template. And lastly, as shown at block 13, the template is removed from the substrate, to clean the substrate, such as for example by stirring in isopropanol or other cleaning agent.

Electrochemical etching is preferably performed by the application of a series of sub microsecond anodic and cathodic potentiostatic or galvanostatic pulses, followed by prolonged anodic potentiostatic step. In particular, short bipolar pulses cause oxide formation during anodic pulse and oxide etching during cathodic pulse, the details of which are provided in the article "*Investigation of Surface-enhanced Raman Scattering from Platinum Electrodes Using a Confocal Raman Microscope: Dependence of Surface Roughening Pretreatment*," by W. B. Cal et al, Surface Science 406 (1998), incorporated by reference herein. The specific parameters of the deposition can vary for each variation of directing agent, for each variation of electrode material, and each variation of porosity desired. Roughness is controlled by pulse amplitude, pulse width, and duration. And this roughening step can be performed on single electrode devices or large surface substrates, such as silicon wafer substrates coated in a thin film of conductive material (e.g., platinum, titanium, gold, titanium nitride, gold, iridium, platinum iridium alloy, diamond).

Upon application of pulses, electrochemistry (oxide growth during anodic pulse and oxide etching during cathodic pulse) happens preferentially on electrode in the vicinity of liquid domains, while solid domains block electrochemical interactions and protect electrode areas next to it from dissolution. Oxide formation during oxidation pulses is a complex process. Chemistry of progressive oxidation stages with reversible and irreversible steps, oxygen species adsorption, diffusion and surface reconstruction are described in (1) "*Thin film platinum cuff electrodes for neurostimulation: in vitro approach of safe neurostimulation parameters*" by S. Mailleya, M. Hylanda, P. Mailleyb, J. A. McLaughlina, E. T. McAdams, Bioelectrochemistry 63 (2004) 359 and (2) "*Real condition of oxidized platinum electrodes: III. Kinetic theory of formation and reduction of surface oxides*" by B. V. Tilak, B. E. Conway, H. Angerstein-Kozlowska, J. Electroanal. Chem. Interfacial Electrochem. 48 (1973) 1-23, FIG. 7, both of which are incorporated by reference herein.

Figure 2A:
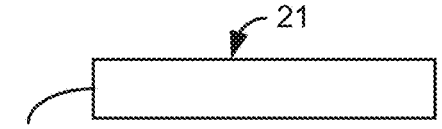
FIGS. 2A-2F together show a schematic progression of another example embodiment of the method of nanoscale surface roughening of a thin film conductive electrode material using a polymer particle-based electrochemical etch template of the present invention.
Figure 2B:
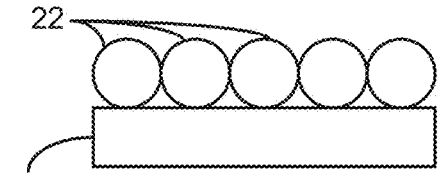
Figure 2C:
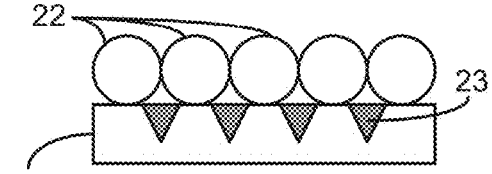
Figure 2D:
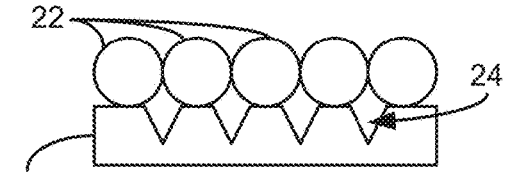
Figure 2E:
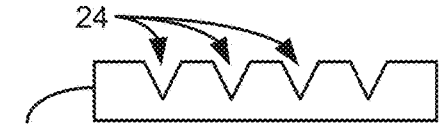
Figure 2F:
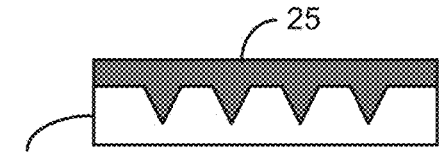

FIGS. 2A-2F together show another example embodiment of the method of nanoscale surface roughening of a thin film conductive electrode material using a polymer particle-based electrochemical etch template of the present invention. Generally, an electrode substrate 20 is first provided having a substrate surface 21, as shown in FIG. 2A. As shown in FIG. 2B, the surface of an electrode substrate is first prepared by forming an electrochemical template on the electrode surface 21 to be roughened. In particular, the template is shown having polymer particles, such as for example microspheres 22, packed as a monolayer on the electrode surface. Oxide formation and oxide removal are next shown separately in FIGS. 2C and 2D, respectively, with oxide formations shown at 23 adjacent the voids between the microspheres, and cavities shown at 24 indicating where the oxide has been removed. It is appreciated, however, that the two steps are preferably cycled in a pulsed etching step to electrochemically etch the templated substrate at the voids of the template. After removing the template, such as with isopropyl alcohol (IPA), the roughened surface of the electrode remains, as shown at FIG. 2E. FIG. 2F also shows an optional material deposition step for depositing a material 25 following template removal.

B. Electrochemical Etch Template Formed from a Solution of Polymer+Acid

Figure 3:
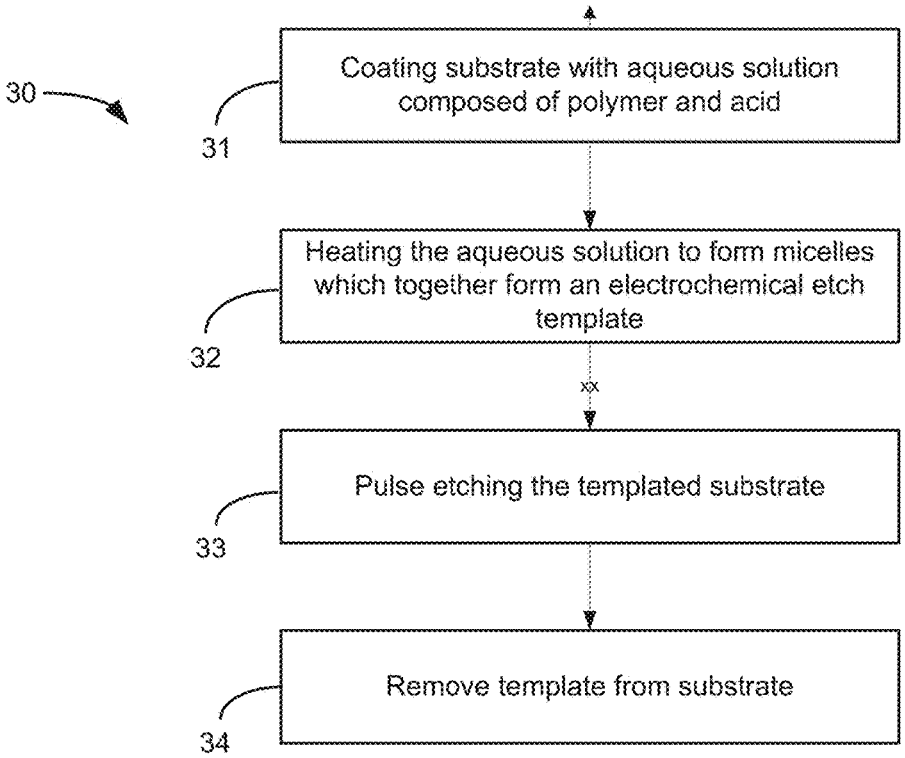
FIG. 3 is a flowchart of another example embodiment of the method for roughening an electrode surface using a polymer-particle-based electrochemical etch template formed from micelles.

FIG. 3 shows a general flowchart of another example embodiment of the method for roughening an electrode surface using a polymer-particle-based electrochemical etch template, generally indicated at reference character 30. At block 31, a substrate is first coated with an aqueous solution composed of polymer and acid (e.g. $H_2SO_4$ or $HClO_4$). At block 32, this is then followed by heating the aqueous solution, to form micelles which together form an electrochemical etch template. Next, at block 33, the templated substrate is pulse etched to oxidize and reduce, i.e. etch, the substrate at the voids of the template, as previously described. And at block 34, the template is removed from the substrate.

Figure 4:
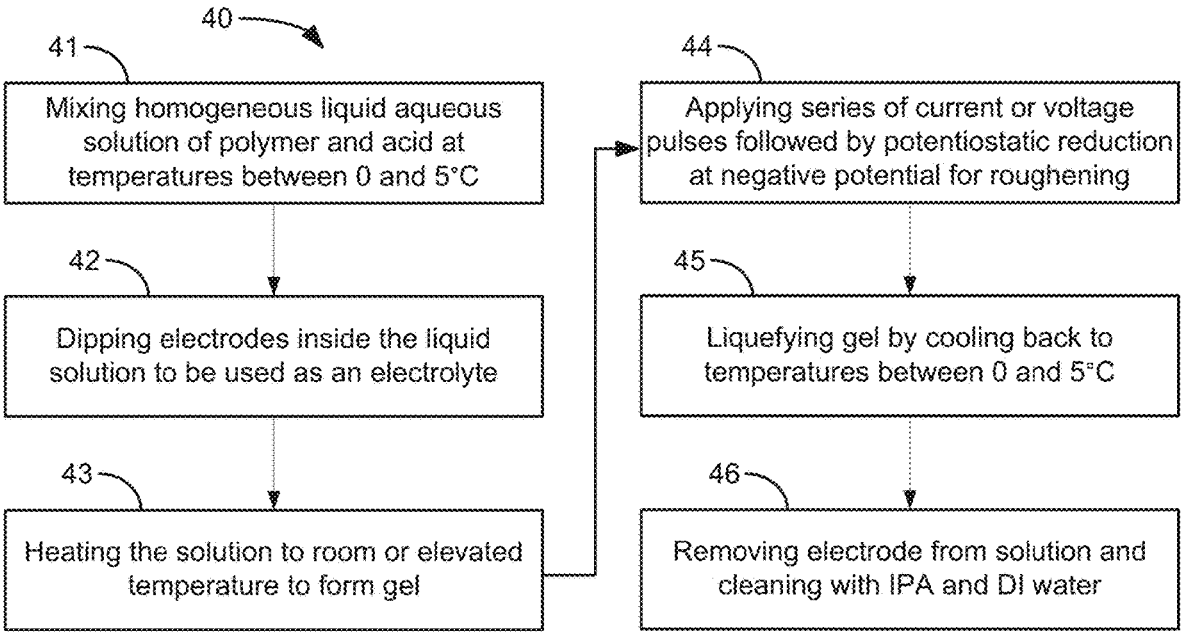
FIG. 4 is a flow chart of another example embodiment of the method for roughening an electrode surface using an electrochemical etch template formed from a polymer and acid solution.

And FIG. 4 shows a more specific flow chart of the method for roughening an electrode surface using an electrochemical etch template formed from a polymer and acid solution, generally indicated at 40. First, as shown at block 41, a homogeneous liquid aqueous solution of polymer and acid is mixed at a temperature between 0 and 5 degrees C. At block 42, an electrode(s) is then dipped in the liquid solution so as to be coated by the liquid solution to be used as an electrolyte. At block 43, the solution is then heated to room or other elevated temperature to form a gel. This produces the micelles which form the solid domain of the template. Next, at block 44, electrical chemical etching is performed by applying a series of current or voltage pulses followed by a potentiostatic reduction at negative potential. At block 45, the gel is then liquefied by cooling to temperatures between 0 and 5 degrees C. The electrode is then removed from the solution and cleaned at block 46, such as with IPA and de-ionized water.

By coating the thin film electrode surface with the aqueous solution composed of an acid and polymer, the surface may be characterized as being coated with a directing agent and directing agent solution. This directing agent solution is composed of an aqueous solution of polymer and acid. In an example embodiment, various concentrations of tri-block copolymer are added to the mild solution of high purity sulfuric acid, mixed and cooled (e.g. stored in the fridge at temperature less than 5° C.) so that the mixture becomes a one phase liquid. In this regard, the electrode may be placed in a vial containing the etch solution while it is cool (below 15° C.) and is in a liquid phase. Upon heating to room or above room temperatures (e.g. 25-60° C.) solution thickens becoming a gel. Micelles are formed throughout the entire volume including electrode-solution interface. Interface is composed of liquid (water and acid) and solid (polymer micelle core) domains separated from each other by several nanometer distances.

Thus in this approach, electrode surface roughening is performed using a solution comprising triblock copolymer which when formed into micelles of a solid domain, acts as a template for electrochemical process occurring at electrode-solution interface. Surface patterning with tri-block copolymers provides a flexible synthesis platform. These uncharged molecules when dissolved in water locally organize in micelles and globally organize in liquid crystals. Aqueous solutions of triblock copolymers are typically liquids at temperatures below 15° C. (when both PEO and PPO chains that the copolymer is composed of are dissolved in water), and become gels at higher temperatures as PPO chains start repelling water and micelles form.

Tri-block copolymers exist in great variety and sizes and phase diagrams of its aqueous solution at temperatures ranging from 0 to 100° C. are complex. Roughening film morphologies may be determined by dimensions and morphology of a liquid crystalline phase. Roughened regions may exhibit ordered patterns (cubic, hexagonal, lamellae, etc.) depending on type and concentration of block copolymers in aqueous solutions and temperature used for electrochemical etching. Roughness domain sizes may be tuned from submicron to tenths of nanometers depending on choice of templating agent and conditions. Therefore, triblock copolymer liquid crystal arrangement at the electrode surface determines morphology of roughened electrode surface. Separation distance between domains of liquid crystal at the interface control distance from hole to hole on roughened surface. Structure of liquid crystal defines regular pattern of holes on the roughened electrode. Phase diagrams of aqueous solution of triblock copolymers could be complex. Copolymers exist in great variety and sizes. Generally: Surface templating with tri-block copolymers provides very flexible platform for thin film surface selective modification.

The size of micelles and micelle-to-micelle separation distances are known to depend on type of the polymer, concentration, temperature and nature of anion in the mixture. Although no data on is available on crystalline structure and dimension for exact acid/tri-block copolymer mixtures to be used for roughening, examples of experimental study of similar liquid crystals can be found in the literature, such as the article "*Electrodeposition of mesoporous manganese dioxide supercapacitor electrodes through self-assembled triblock copolymer templates*," by Tone Xue et al, Elsevier (2008), incorporated by reference herein. Briefly, crystal structure and lattice parameter of mixture of metal salt with P123 and F127 tri-block copolymers were determined from measured low-angle XRD spectra of liquid crystals.

After roughening, the electrode surface may be cleaned, such as for example by stirring in isopropanol or other cleaning agent.

The roughening and cleaning steps may optionally be followed by deposition of another thin film electrode material (e.g., platinum, titanium, gold, titanium nitride, iridium, iridium oxide, platinum iridium alloy, carbon-based electrodes, conductive polymers) by electrochemical deposition, chemical, or physical deposition such as chemical vapor deposition, sputtering, or electron-ebeam evaporation.

Experiment 1

Figure 5:
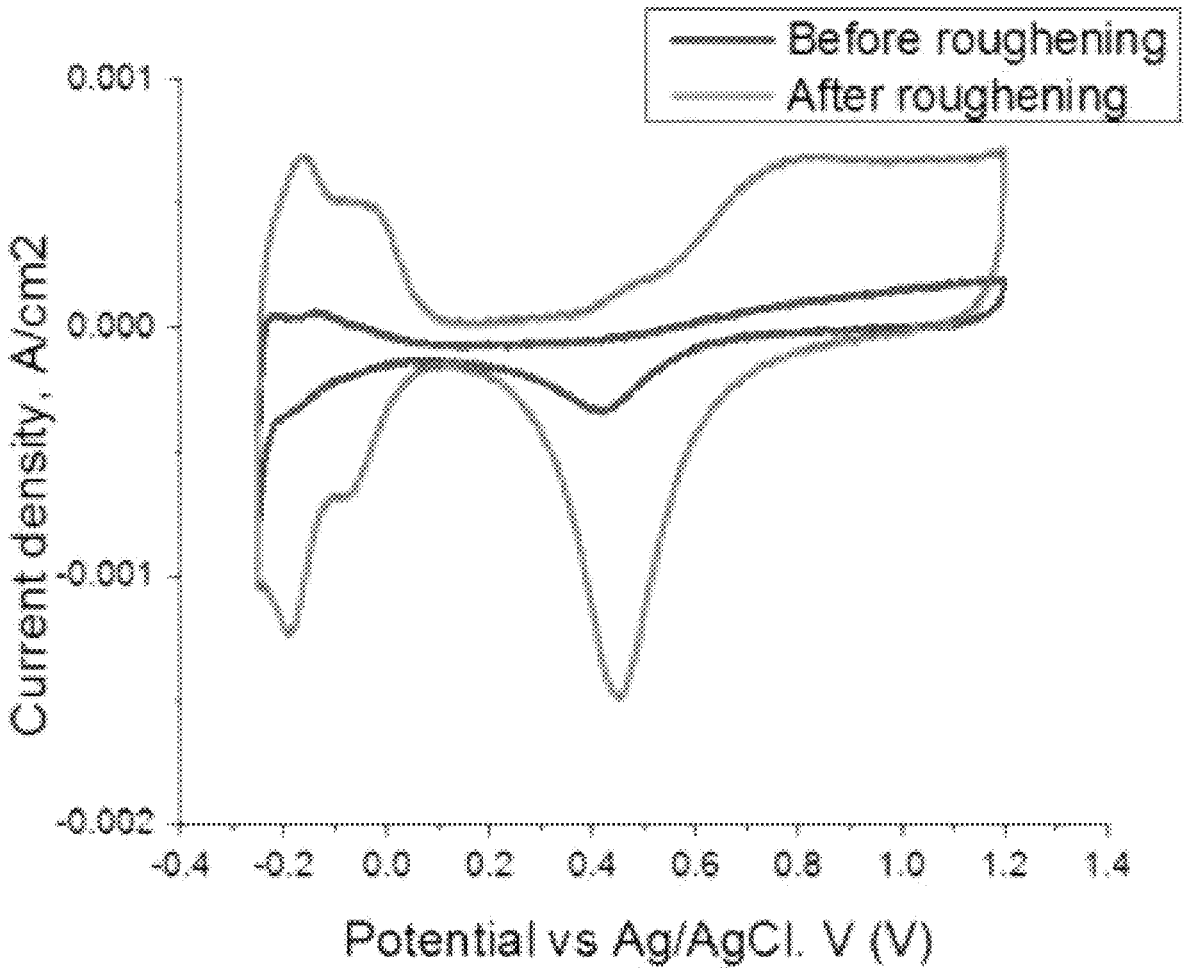
FIG. 5 is a graph of cyclic voltammetry measured before and after roughening in 0.1M $H_2SO_4$ solution purged with $N_2$ prior to tests (scan rate: 100 mV/s), in a first experiment.

In a first experiment, a platinum electrode of 2 μm thickness with rectangular geometry 1 by 1.4 mm on Si substrate was roughened in Pluronic F127 aqueous acidic solution. FIG. 5 shows cyclic voltammetry measured before and after roughening in 0.1M $H_2SO_4$ solution purged with $N_2$ prior to tests (scan rate: 100 mV/s). Higher current density after roughening is indicative of increased active surface area as a result of roughening. No delamination or visual changes to the surface were observed after roughening. Roughening was done in 28 wt. % F127 solution in 0.5M $H_2SO_4$ at 55° C. after solution became gel. Potentiostatic pulses 1.7V/−0.155V vs. AgAgCl electrode with pulse width 4 ms/4 ms and total duration of 10 seconds were applied during roughening procedure. Estimation of surface area increase from Hydrogen Adsorption peaks during Cyclic Voltammetry gave increase in active surface area by 6.8 times.

C. Electrochemical Etch Template Formed from Polystyrene Microspheres

In another example embodiment of the present invention, monodispersed latex microspheres can be used as a template for electrochemical etching. For example, polystyrene latex microspheres may be used having diameter sizes ranging from, for example 50 nm to 10 microns. Film composed of microspheres can be applied to the electrode surface by method described in detail in the article entitled, "*Highly Ordered Macroporous Gold and Platinum Films Formed by Electrochemical Deposition through Templates Assembled from Submicron Diameter Monodisperse Polystyrene Spheres*," by P. N. Bartlett et al, Chem. Mater (2002), incorporated by reference herein. The amount of colloid suspension to be deposited should be calculates from consideration that the coverage of exposed electrode area must exceed a complete layer. Close packed arrangement of spheres covering the surface is expected if access of a monolayer is formed. Selective film roughening will occur in the vicinity of voids between spheres covering electrode surface. Roughened film will retain ordered closed packed structure of microspheres used for the template.

Figure 6:
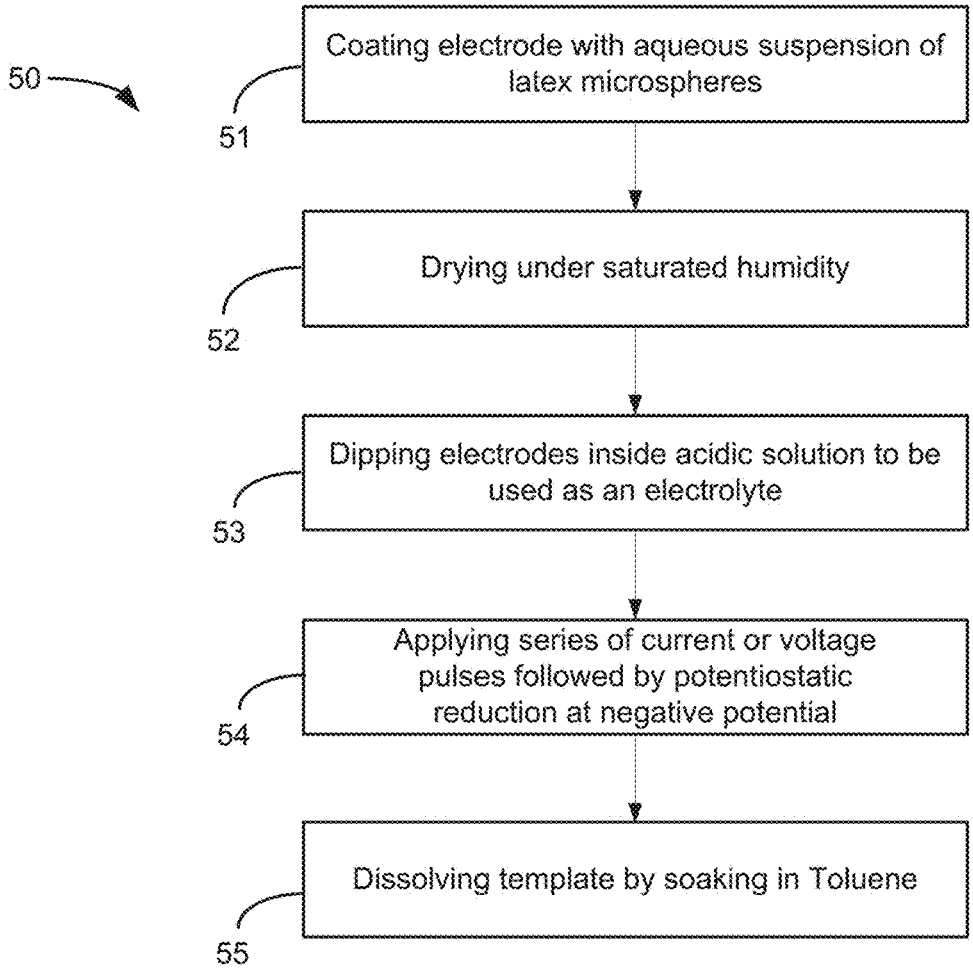
FIG. 6 is a flowchart of another example embodiment of the method for roughening an electrode surface using a polymer-particle-based electrochemical etch template using monodispersed latex microspheres.

FIG. 6 shows a flowchart illustrating an example of this method, generally indicated at reference character 50. At block 51, the electrode is first coated with an aqueous suspension of latex microspheres. This is followed at block 52 by slowly drying under saturated humidity. Next at block 53, the electrodes are dipped in an acidic solution to be used as an electrolyte. Next, at block 54, electrical chemical etching is performed by applying a series of current or voltage pulses followed by a potentiostatic reduction at negative potential. The template is then dissolved by soaking in Toluene, as shown at block 55.

2. Thin Film Electrode Surface Roughening Via Electrochemical Etching in Adsorbing and Nonadsorbing Electrolyte In a second example embodiment of the present invention, pulsed electrochemical etching of thin film electrodes is carried out by exposing a surface of the electrode to either an ionic solution of an adsorbing electrolyte (e.g. sulfuric acid) or a non-adsorbing electrolyte (e.g. perchloric acid) alone, i.e. without a polymer, and then applying a series of anodic and cathodic potentiostatic or galvanostatic pulses (1-3 microsecond per phase), followed by prolonged anodic potentiostatic step, as described previously. In particular, short bipolar pulses cause oxide formation during anodic pulse and oxide etching during cathodic pulse. The specific parameters of the deposition can vary for each variation of directing agent, for each variation of electrode material, and each variation of surface roughness desired. Roughness is controlled by pulse amplitude, pulse width, and pulsing duration. And this roughening step can be performed on single electrode devices or large surface substrates, such as silicon wafer substrates coated in a thin film of conductive material (e.g., platinum, gold, iridium, palladium, platinum iridium alloy, diamond).

In particular, this embodiment of the method of electrochemically roughening a substrate may comprise: immersing a surface of the substrate in an ionic solution; and electrochemically pulse etching the surface of the substrate, wherein the electrochemical pulse etching is performed in a relatively narrow frequency range (e.g. about 150 Hz to about 450 Hz for Pt roughened in sulfuric acid) for adsorbing solution (e.g. sulfuric acid), or a wide range of frequencies (e.g. about 250 Hz to about 5000 Hz for Pt in perchloric acid) for non-adsorbing solution (e.g. perchloric acid). Roughening in adsorbing solution requires careful selection of pulsing frequency and occurs through inter-grain dissolution that may compromise film integrity. Roughening in non-adsorbing solution occurs at wide frequency range through material re-deposition. Roughening in non-adsorbing solution does not compromise film integrity and therefore is better suited for biosensors and neural probe applications.

Figure 7:
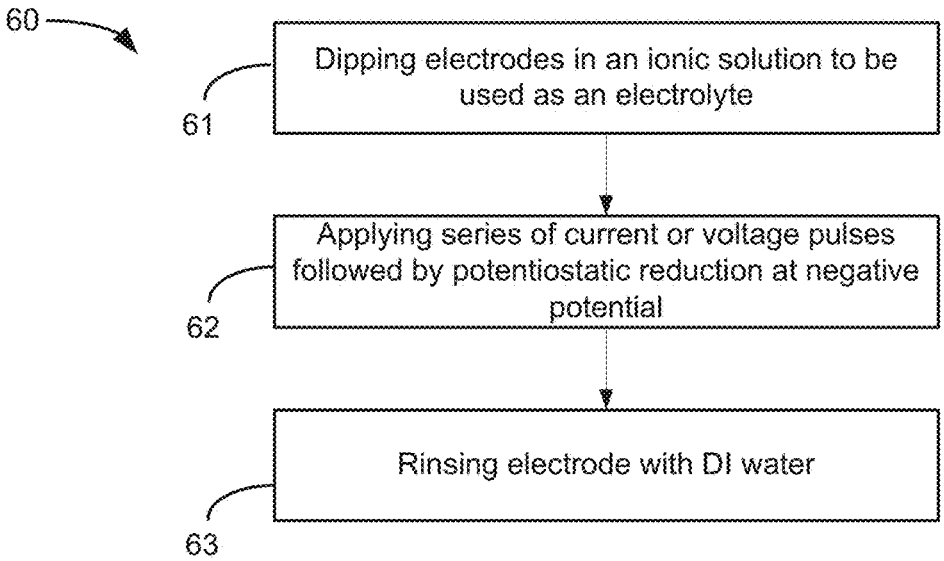
FIG. 7 is a flowchart of another example embodiment of the method of roughening with no template.

FIG. 7 shows a flowchart of an example embodiment of the method of roughening with no template, generally indicated at reference character 60. First, at block 61, electrodes are dipped in an ionic solution to be used as an electrolyte. Next, at block 62, a series of current or voltage pulses are then applied followed by potentiostatic reduction at negative potential. The electrode may then be rinsed with de-ionized water at block 63.

Roughening of spattered thin Pt film via electrochemical etching in sulfuric acid solution is preferably performed using a narrow pulsing frequency range of about 150-450 Hz, which is different from frequency range for roughening of Pt foil (1-1.5 Hz). In this range, thin film roughening may proceed without delamination. In this case, the electrolyte used for roughening is an aqueous solution comprising an acid alone (without polymer) e.g. 0.1-1M $H_2SO_4$. Usage of chloride-based reference electrodes are preferably avoided because contamination of solution with chloride ions may alter rates of oxidation. Several experimental tests performed by Applicants (discussed next) have produced results showing roughening for macro- and micro-size electrodes. Verification of surface roughening was obtained from images collected using scanning electron microscopy.

Roughening of spattered thin Pt film via electrochemical etching in a non-adsorbing acid solution, such as for example percholoric acid solution, may be performed at a wide frequency range and allowing to roughen films via Pt re-deposition that better suits biomedical applications than roughening in adsorbing solution that results in inter-grain boundary dissolution compromising film integrity.

Experiment 2

Figure 8A:
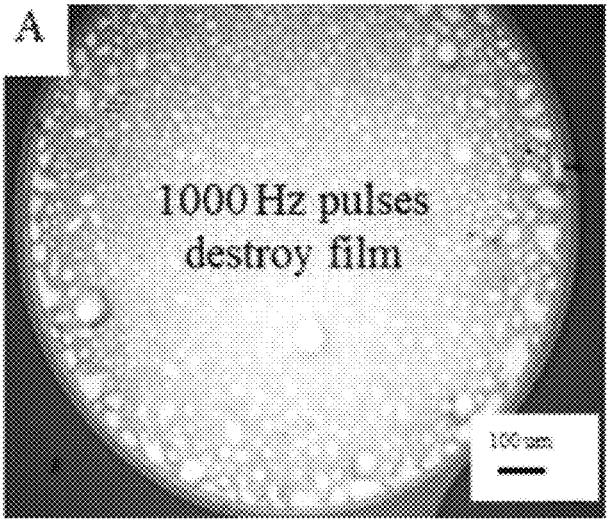
FIGS. 8A and 8B show the microscopy of two samples roughened in a thin film roughening test under different pulsing conditions in a second experiment.
Figure 8B:
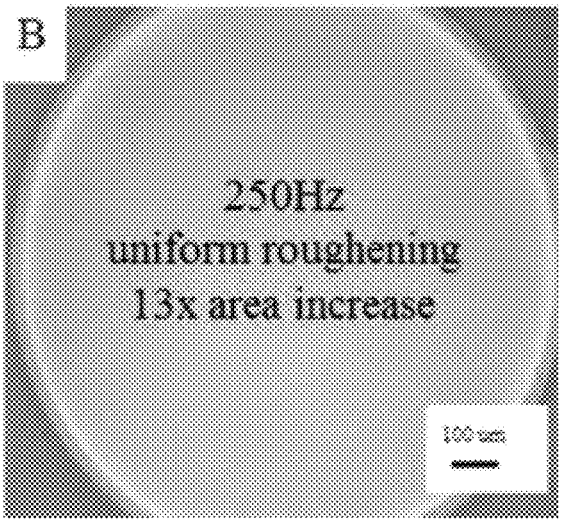

Platinum thin film macro-electrodes (thickness: 2 μm) with circular geometry (diameter: 1.2 mm) deposited by spattering on Si substrate were used for thin film roughening tests, as shown in FIGS. 8A and 8B, which show the microscopy of two samples roughened under different pulsing condition: FIG. 8A, Pulse amplitude: 2.2/−0.15 V vs. Ag/AgCl, duration: 100 seconds, frequency: 1000 Hz; FIG. 8B, Pulse amplitude: 1.9/−0.15 V vs. Ag/AgCl, duration: 100 seconds, frequency: 250 Hz. Roughening was performed by application of oxidation-reduction pulses in 0.5M H2SO4 (99.999% purity) aqueous solution. In order to avoid contamination with chloride ion that is known to alter Pt oxidation, leakless Ag/AgCl reference electrode, product of eDAQ company (product number ET069-1) was used for 3-electrode experiments. VersaSTAT 4 (a product of Princeton Applied Research) potentiostat was used for electrochemical experiments. Electrodes were initially cleaned in 0.5M H2SO4 solution by running 50 repetitive CV cycles between potentials of hydrogen and oxygen evolution with 100 mV/s scan rate.

Exact recipes for roughening of Pt thick metal (foil) from publications 1) "a square wave of 1 kHz−0.4/2.4 V vs Ag|Ag2SO4|sat K2SO4 applied to the electrode in 0.5 M sulfuric acid solution for 15 s to 5 min after which the potential was maintained at −0.4 V until oxides on the surface were completely reduced" ((Weremfo, Carter, Hibbert, & Zhao, 2015)) or 2) "a square wave of 1.5 kHz with upper and lower switching potentials of 2.4 V and −0.2 V (2-electrode setup) was applied to the electrode in 0.5 M H2SO4 for a period ranging from 5 s to 10 min, and then the electrode was held at −0.2 V until the electroreduction of the surface was completed" (Cai, Ren, Li, She, Liu, & Cai, 1998) resulted in no roughening when were applied to thin films. Attempt to increase pulse amplitude from 2.1V vs Ag/AgCl (2.1 V amplitude, 1 kHz frequency, 100 s duration) for which no roughening effect was observed to 2.2V vs Ag/AgCl (2.2 V amplitude, 1 kHz frequency, 100 s duration) resulted in film delamination (see FIG. 8A). Experiments show that thin film roughening can be achieved if oxidation-reduction pulse frequency is decreased. Sample B roughened under lower frequency of 250 Hz shows uniform roughening (see FIG. 8B) with 13× increase in active area (as determined from Hydrogen Adsorption peaks during Cyclic Voltammetry in 0.5M H2SO4 (method from (José M. Doña Rodríguez, 2000)).

Experiment 3

In another study, the effect of frequency of oxidation-reduction pulses on roughness parameter was investigated on three types of electrodes: 1) thick Pt disk electrode 2 mm in diameter, product of CH Instruments, Inc.; 2) platinum thin film macroelectrodes (thickness: 2 μm) with circular geometry (diameter: 1.2 mm) deposited by spattering on Si substrate in cleanroom environment at LLNL.

Roughening was performed by application of oxidation-reduction pulses in 0.5M H2SO4 (99.999% purity) aqueous solution. In order to avoid contamination with chloride ion that is known to alter Pt oxidation, leakless Ag/AgCl reference electrode, product of eDAQ company (product number ET069-1) was used for 3-electrode experiments. VersaSTAT 4 (product of Princeton Applied Research) potentiostat was used for electrochemical experiments. All electrodes were initially cleaned in 0.5M H2SO4 solution by running 50 repetitive CV cycles between potentials of hydrogen and oxygen evolution with 100 mV/s scan rate. Increase in active area was determined from Hydrogen Adsorption peaks during Cyclic Voltammetry in 0.5M $H_2SO_4$ (method from (José M. Doña Rodríguez, 2000)).

Figure 9:
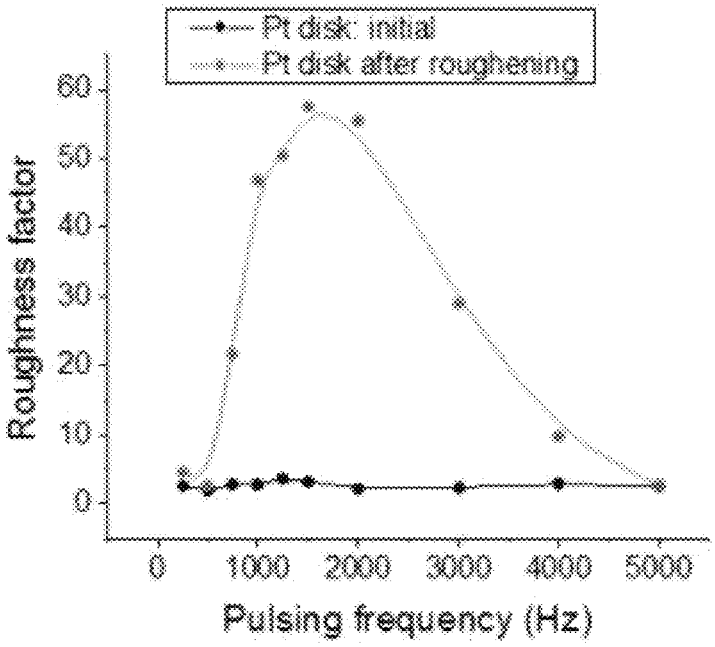
FIG. 9 is a graph of the roughness factor of Pt disk 2 mm diameter electrodes as a function of pulsing frequency used for roughening, in a first sample set of a third experiment.

Platinum disk electrodes were re-polished before each roughening test with 15, 3 and 1 micron diamond polish for 1 minute with each polishing solution (PK-4 Polishing Kit, product of BASi). Pt disk electrodes (sample set 1) were roughened by application of oxidation-reduction pulses 1.9/−0.15 V vs Ag/AgCl amplitude with 100 seconds duration followed by −0.15 V potentiostatic reduction for 4 minutes. Pulsing frequency was varied sample to sample in a range between 250 and 5000 Hz. Roughness factor before and after roughening is shown on FIG. 9. In particular, FIG. 9 shows the roughness factor of Pt disk 2 mm diameter electrodes as a function of pulsing frequency used for roughening. Roughness parameters common for all the tests: 1.9/−0.15 V vs AgAgCl pulsing for 100 seconds followed by 4 minute potentiostatic reduction at −0.15 V vs Ag/AgCl. Results show that optimal frequency for roughening of thick Pt is in the range of 1-2.5 kHz. Roughening effect for pulsing with frequency outside range below 250 Hz and above 5000 Hz is negligible.

Figure 10:
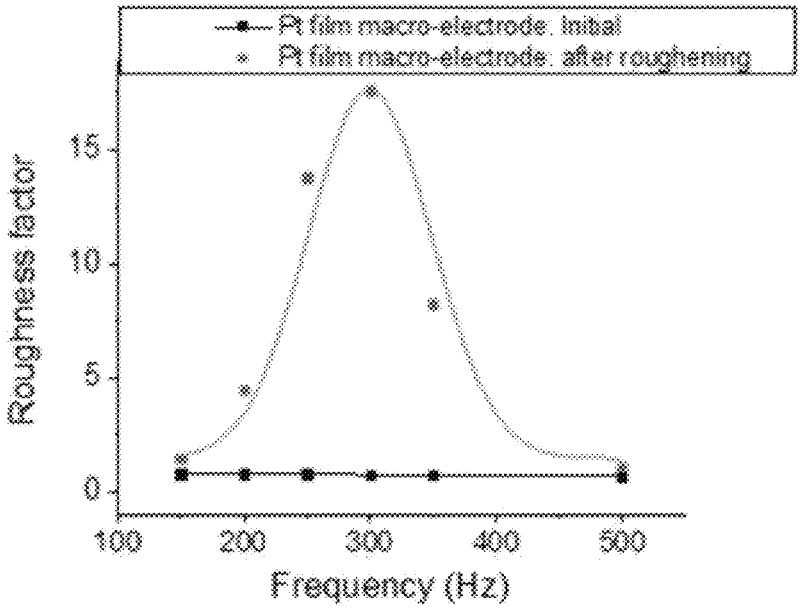
FIG. 10 is a graph of the roughness factor of Pt thin film macro-electrodes 1.2 mm diameter as a function of pulsing frequency used for roughening, in a second sample set of the third experiment.

Second sample set (2) of thin Pt film electrodes with 1.2 mm diameter were roughened by applying oxidation-reduction pulses 1.9/−0.15 V vs Ag/AgCl amplitude with 100 seconds duration followed by −0.15 V potentiostatic reduction for 4 minutes. Pulsing frequency was varied sample to sample in a range between 150 and 1500 Hz. Roughness factor before and after roughening is shown on FIG. 10. In particular, FIG. 10 shows the roughness factor of Pt thin film macro-electrodes 1.2 mm diameter as a function of pulsing frequency used for roughening. Roughness parameters common for all the tests: 1.9/−0.15 V vs AgAgCl pulsing for 100 seconds followed by 4 minute potentiostatic reduction at −0.15 V vs Ag/AgCl. Results show that optimal frequency for roughening of thin Pt macro-electrodes is in the range of 250-350 Hz. Roughening effect for pulsing with frequency outside range below 150 Hz and above 500 Hz is negligible.

Figure 11A:
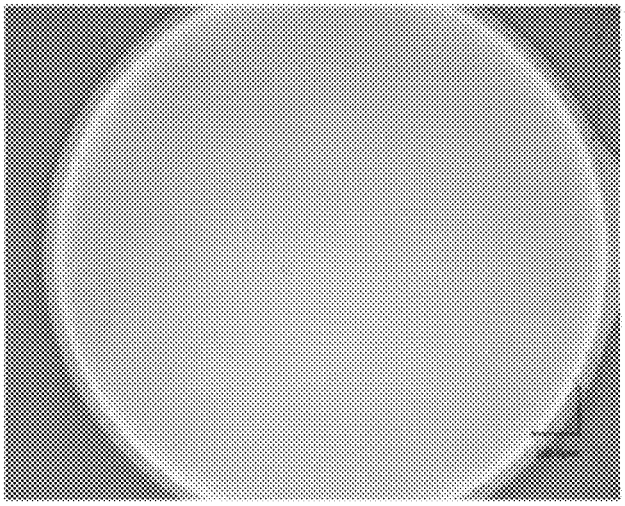
FIGS. 11A and 11B show the microscopy of surface of roughened in sulfuric acid thin film macro-electrode 1.2 mm in diameter at two different magnifications.
Figure 11B:
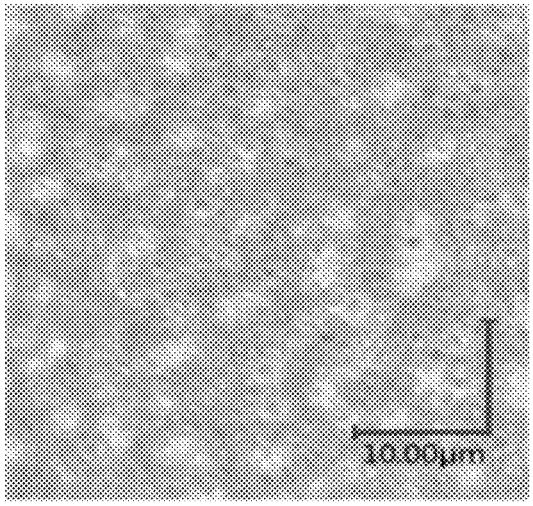
Figures 14A, 14B:
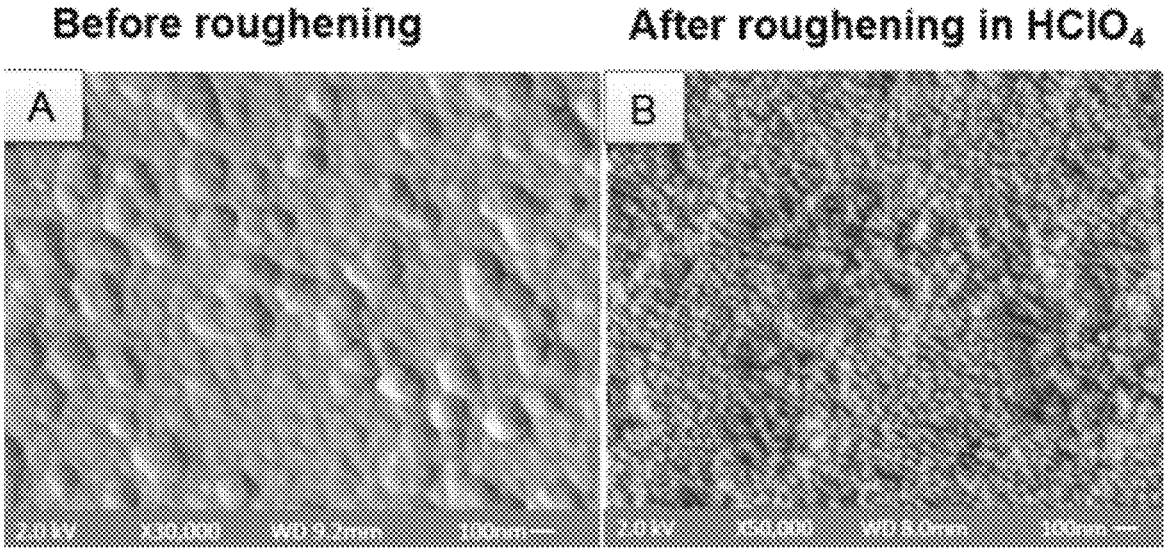
FIGS. 14A and 14B show surface morphology of macroelectrode (0.5×1.5 mm dimensions) obtained by Scanning Electron Microscopy of spattered Pt film before (FIG. 14A) and after (FIG. 14B) roughening in perchloric acid, and with Roughness factor: 44.

Microscopy of the surface of a roughened thin film macro-electrode 1.2 mm in diameter is shown on FIGS. 11A and 11B at two different magnifications. In particular, FIGS. 11A and 11B shows the microscopy of a roughened thin macro-electrode 1.2 mm in diameter. Roughness parameters: 1.9/−0.15 V vs Ag/AgCl pulsing at 250 Hz for 100 seconds followed by 4 minute potentiostatic reduction at −0.15 V vs Ag/AgCl. Microscopy confirms that roughening is uniform throughout the whole area of the electrode with no signs of delamination. Increase in surface area by factor of 13 was achieved. Examination of roughened film morphology under SEM reveals that roughening in sulfuric acid results in preferential grain boundary dissolution. Effect was attributed to adsorbing properties of sulfuric acid anions that may hinder Pt grain reactivity. Non-adsorbing perchloric acid was tested as electrolyte for roughening instead.

Experiment 4

In another study, the effect of adsorbing properties of electrolyte solution on roughened film morphology was investigated on platinum thin film macroelectrodes (thickness: 2 μm) with rectangular geometry (0.5×1.5 mm) deposited by spattering on Si substrate in cleanroom environment at LLNL. Aqueous solution of perchloric acid was selected as electrolyte of choice for this study due to its known mild adsorption on Pt surface.

Roughening was performed by application of oxidation-reduction pulses in 0.5M $HClO_4$ (99.999% purity) aqueous solution. In order to avoid contamination with chloride ion that is known to alter Pt oxidation, leakless Ag/AgCl reference electrode, product of eDAQ company (product number ET069-1) was used for 3-electrode experiments. VersaSTAT 4 (product of Princeton Applied Research) potentiostat was used for electrochemical experiments. All electrodes were initially cleaned in 0.5M HClO4 solution by running 50 repetitive CV cycles between potentials of hydrogen and oxygen evolution with 100 mV/s scan rate. Increase in active area was determined from Hydrogen Adsorption peaks during Cyclic Voltammetry in 0.5M $HClO_4$ (method from (José M. Doña Rodríguez, 2000)). Application of roughness parameters 1.9/−0.15 V vs AgAgCl pulsing for 300 seconds followed by 4 minute potentiostatic reduction at −0.15 V vs Ag/AgCl resulted in obtaining uniformly roughened surface (Microscopy image shown on FIG. 13). Surface area was found to increase 44 times from increased hydrogen adsorption charge observed in CV.

Examination of roughened film morphology under SEM revealed that roughening in perchloric acid occurs with re-deposition of dissolved Pt (crystal size 20-30 nm). No inter-grain material dissolution was observed under SEM. Therefore, switching electrolyte from adsorbing H2SO4 to non-adsorbing HClO4 allowed roughening without inter-grain dissolution that is known to compromise electrode materials and should be avoided.

Experiment 5

Figures 15A, 15B, 15C:
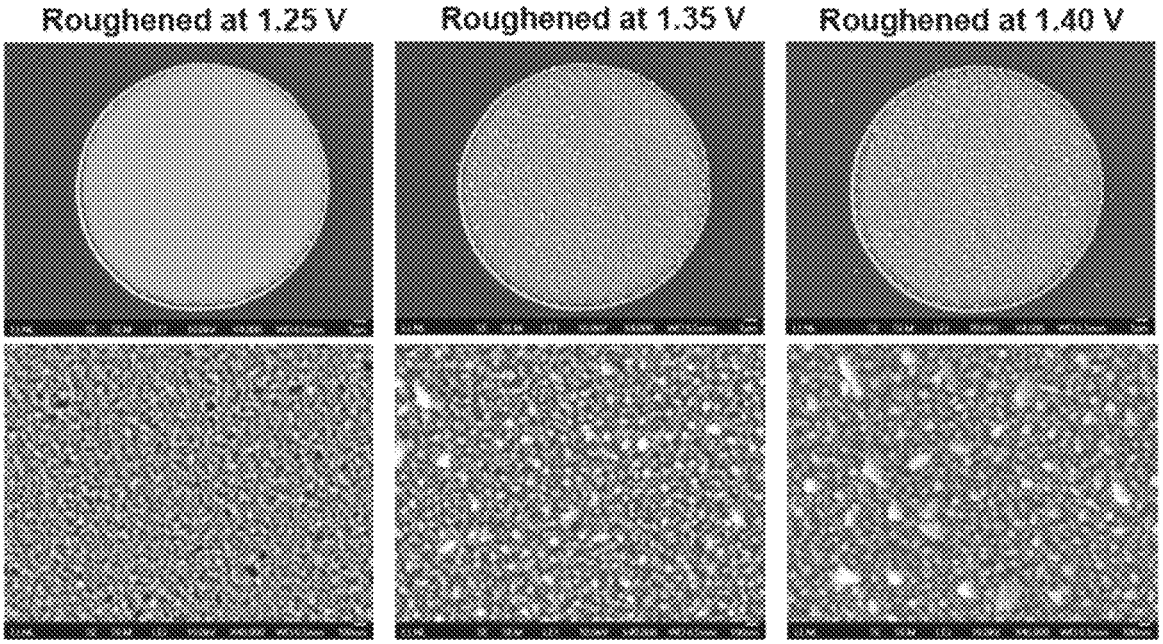
FIGS. 15A-C show surface morphology obtained by Scanning Electron Microscopy of Pt microelectrodes (20 μm diameter) roughened at different pulse amplitude in perchloric acid (FIG. 15A roughened at 1.25 V, FIG. 15B roughened at 1.35 V, and FIG. 15C roughened at 1.4 V) vs Ag/AgCl. Other parameters: frequency 4 kHz; negative pulse amplitude −0.25 V vs Ag/AgCl followed by prolonged potentiostatic reduction at −0.25V vs Ag/AgCl for 4 minutes.

In another study, roughening method was applied towards increasing surface area of thin film macroelectrodes (diameter: 20 μm; thickness: 250 nm) deposited by spattering on polyimide flexible substrate in cleanroom environment at LLNL. Aqueous solution of perchloric acid (0.5 M aqueous solution) was selected as electrolyte of choice due to more suitable film morphology for biomedical applications. Microelectrodes were roughened at different pulse amplitude in perchloric acid A) 1.25 V; B) 1.35 V; C) 1.4 V vs Ag/AgCl. Other parameters used for roughening were: frequency 4 kHz; negative pulse amplitude −0.25 V vs Ag/AgCl followed by prolonged potentiostatic reduction at −0.25V vs Ag/AgCl for 4 minutes. Examination of roughened film morphologies with SEM confirmed that roughening did not result in film damage by cracks or delamination (FIG. 15). Crystallites due to Pt re-deposition were observed for all microelectrodes tested. Film roughened at higher voltage showed larger crystals re-deposited on the surface.

Although the description above contains many details and specifics, these should not be construed as limiting the scope of the invention but as merely providing illustrations of some of the presently preferred embodiments of this invention. Other implementations, enhancements and variations can be made based on what is described and illustrated in this patent document. The features of the embodiments described herein may be combined in all possible combinations of methods, apparatus, modules, systems, and computer program products. Certain features that are described in this patent document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination. Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the embodiments described above should not be understood as requiring such separation in all embodiments.

Therefore, it will be appreciated that the scope of the present invention fully encompasses other embodiments which may become obvious to those skilled in the art. In the claims, reference to an element in the singular is not intended to mean "one and only one" unless explicitly so stated, but rather "one or more." All structural and functional equivalents to the elements of the above-described preferred embodiment that are known to those of ordinary skill in the art are expressly incorporated herein by reference and are intended to be encompassed by the present claims. Moreover, it is not necessary for a device to address each and every problem sought to be solved by the present invention, for it to be encompassed by the present claims. Furthermore, no element or component in the present disclosure is intended to be dedicated to the public regardless of whether the element or component is explicitly recited in the claims. No claim element herein is to be construed under the provisions of 35 U.S.C. 112, sixth paragraph, unless the element is expressly recited using the phrase "means for."

We claim:

1. A method of electrochemically roughening a substrate, comprising:

forming an electrochemical etch template comprising polymer particles adsorbed on a surface of a substrate to be roughened; and electrochemically etching exposed regions of the substrate defined by voids between the polymer particles in the electrochemical etch template so as to selectively roughen the surface of the substrate.

2. The method of claim 1, wherein the step of forming the electrochemical etch template includes coating a surface of the substrate with an aqueous solution comprising polymer and acid, and heating the aqueous solution so that the polymer forms a solid domain of a liquid crystal which forms an electrochemical etch template on the surface of the substrate.

3. The method of claim 1, wherein the step of forming the electrochemical etch template includes coating a surface of the substrate with polystyrene microspheres.

4. A method of electrochemically roughening a Pt thin film substrate, comprising:

immersing a surface of the substrate in an adsorbing acidic solution; and electrochemically pulse etching the surface of the substrate, wherein the electrochemical pulse etching is performed in a frequency range of greater than 200 Hz to about 450 Hz.

5. The method of claim 4, wherein the adsorbing acidic solution is sulfuric acid.

6. A method of electrochemically roughening a Pt thin film substrate, comprising:

immersing a surface of the substrate in a non-adsorbing acidic solution; and electrochemically pulse etching the surface of the substrate, wherein the electrochemical pulse etching is performed in a frequency range of about 250 Hz to about 5000 Hz.

7. The method of claim 6, wherein the non-adsorbing acidic solution is perchloric acid.

* * * * *